United States Patent [19]

Asai et al.

[11] 4,154,629

[45] May 15, 1979

[54] PROCESS OF CASE HARDENING MARTENSITIC STAINLESS STEELS

[75] Inventors: Takeji Asai; Kaishu Yamazumi, both of Toyama; Teruyoshi Sakuta, Nishinomiya, all of Japan

[73] Assignee: Kabushiki-Kaisha Fujikoshi, Toyama, Japan

[21] Appl. No.: 752,924

[22] Filed: Dec. 21, 1976

[30] Foreign Application Priority Data

Dec. 23, 1975 [JP] Japan ..... 50/15454

[51] Int. Cl.[2] ..... C21D 1/48

[52] U.S. Cl. ..... 148/16.7; 148/16.5; 148/16.6; 148/31.5

[58] Field of Search ..... 148/16, 16.5, 16.6, 148/12.1, 16.7, 31.5

[56] References Cited

U.S. PATENT DOCUMENTS

| | | | |
|---|---|---|---|
| 2,786,003 | 3/1957 | Hollingsworth et al. | 148/16.6 |
| 3,201,290 | 8/1965 | Wyss | 148/16.5 |
| 3,344,817 | 10/1967 | Connard | 148/16.6 |
| 4,006,042 | 2/1977 | Kieferle | 148/16.5 |
| 4,042,428 | 8/1977 | Asai et al. | 148/16.5 |

FOREIGN PATENT DOCUMENTS

| | | | |
|---|---|---|---|
| 578601 | 6/1959 | Canada | 148/16.5 |
| 46-6326 | 2/1971 | Japan | 148/16.5 |
| 875998 | 8/1961 | United Kingdom | 148/16.5 |

OTHER PUBLICATIONS

Metals Handbook, 8th. Ed., vol. 2, 1974, pp. 125, 126, 151, 152 and 154.

*Primary Examiner*—L. Dewayne Rutledge
*Assistant Examiner*—John P. Sheehan
*Attorney, Agent, or Firm*—Spencer & Kaye

[57] ABSTRACT

A process for case hardening martensitic stainless steels comprising the steps of forming non-explosive and neutral or weakly reducing atmosphere consisting essentially of 97.5% to 95% by volume of nitrogen gas, 0.5% to 1.5% by volume of carbon monoxide and 2% to 3.5% by volume of hydrogen gas. The carbon monoxide and hydrogen gases are produced by heat decomposition of an organic solvent mixed with the nitrogen gas. The martensitic stainless steel is heated in this atmosphere at a solution heat treatment temperature in the range 900° C. to 1100° C. for a period required to cause nitriding of a surface thereof to a predetermined depth. The steel is then quenched at a temperature within the range of 150° C. to room temperature, the quenching gas being selected from the group consisting of nitrogen gas and the resulting gaseous atmosphere. As a result of this process, resistance against planar pressure by loads and the strength of the martensitic stainless steel are increased. The stainless steel thus treated has bright surfaces and high corrosion resistance.

2 Claims, 3 Drawing Figures

PROCESS OF CASE HARDENING MARTENSITIC STAINLESS STEELS

BACKGROUND OF THE INVENTION

The present invention relates to a process for case hardening martensitic stainless steels.

The chemical compositions of martensitic stainless steels are shown in the following Table 1.

TABLE 1

| TYPE | | | WEIGHT % | | | | |
|---|---|---|---|---|---|---|---|
| JIS | AISI | BS | C | Si | Mn | Ni | Cr |
| 410 | 410 | (En56B) | <0.15 | <1.00 | <1.00 | <0.60 | 11.50 ~13.50 |
| 440A | 440A | — | 0.60 ~0.75 | " | " | " | 16.00 ~18.00 |
| 440C | 440C | — | 0.95 ~1.20 | " | " | " | 16.00 ~18.00 |
| 420F | 420F | En56D | 0.26 ~0.40 | " | " | " | 12.00 ~14.00 |

There are many recent examples in which stainless steels have been hardened by solution heat-treatment for use in machine parts, tools, and screws, etc. which tend to undergo undesirable corrosion. However, with conventional heat-treating methods, it is difficult to obtain bright surfaces and sufficient hardness. Furthermore, these methods involve a problem relating to the corrosion resistance of the surface layer. In particular, screws require both sufficient resistance against planar pressure by loads and sufficient strength to withstand their normal use.

Screws used for structures made of a non-ferric material such as aluminum or copper, or thin sheet steel are frequently used directly for tapping without drilling holes in the structures beforehand. While the screws used for this purpose are required to have high hardness and tensile strength, the conventional heat-treating methods have a disadvantage in that the screws obtained by such treatments do not have sufficient surface hardness.

In general, various treating methods such as carburizing, carbonitriding, and nitriding have been widely used heretofore to harden the surfaces of the usual iron steels as well as stainless steels. Stainless steel is a material which is difficult to carburize and nitride, and these prior surface-treating methods do not work satisfactorily because they cause the corrosion resistance of the stainless steel to deteriorate. With respect to the solution heat-treatment of martensitic stainless steels, therefore, it has long been desired to realize a hardening treatment without impairing their corrosion resistance.

As for the solution heat-treatment of martensitic stainless steels, what has generally and frequently been employed is a process comprising heating a martensitic stainless steel to 920°-1070° C. and then quenching it. The conventional treatment process, however, results in a poor surface condition and it is difficult to obtain sufficient hardness and high corrosion resistance.

As regards the nitrogen gas, it is theoretically known that molecular nitrogen dissociates into atomic nitrogen at high temperature. When molecular nitrogen directly dissociates into atomic nitrogen, dissociation occurs in accordance with the following formula (1).

$$N_2 \rightarrow 2N + 224.86 \text{ kcal} \ldots \quad (1)$$

In other words, conversion of 1 mole of molecular nitrogen to atomic nitrogen requires an energy of 224.86 kcal. It is anticipated, therefore, that conversion to atomic nitrogen is extremely difficult.

In the presence of oxygen at high temperatures, nitrogen oxide is formed by the reaction defined by formula (2), and then atomic nitrogen is dissociated in accordance with formula (3).

$$N_2 + O_2 \rightarrow 2NO + 43.2 \text{ kcal} \ldots \quad (2)$$

$$NO \rightarrow N + \tfrac{1}{2}O_2 + 90.85 \text{ kcal} \ldots \quad (3)$$

It is known that in the process of forming nitrogen oxide by the combination of nitrogen and oxygen in the reaction of formula (2), the reaction proceeds at a very high temperature. But it is assumed that the rate of reaction is extremely slow, and the reaction scarcely proceeds even in the presence of a flame.

Atomic nitrogen is required in order to cause the adsorption and diffusion of nitrogen on the surface of the stainless steel to be treated. Usually, however, nitriding is extremely difficult by reactions based on formulae (1), (2) and (3), and therefore case hardening by the diffusion of nitrogen is extremely difficult.

SUMMARY OF THE INVENTION

In view of the above considerations, it is an object of the present invention to resolve the above-mentioned problems, and more specifically to increase the resistance against planar pressure by loads as well as the strength of martensitic stainless steel to be hardened by a solution heat treatment and to obtain a stainless steel which has bright surfaces and high corrosion resistance.

In order to achieve the above-mentioned objects, according to the present invention, a very small amount of an organic solvent which produces by heat decomposition about 0.5% to 1.5% by volume carbon monoxide gas and about 2% to 3.5% by volume hydrogen gas is mixed with about 97.5% to 95% by volume nitrogen gas and then the mixture of the organic solvent and the nitrogen gas is subjected to heat decomposition to produce a non-explosive and neutral or weakly reducing atmosphere. Subsequently, a martensitic stainless steel is heated at a solution heat treatment temperature within an approximate range of 900° C. to 1100° C. in the resulting gaseous atmosphere so that atomic nitrogen is adsorbed and diffused onto the surfaces of the stainless steel at the solution heat treatment temperature so that nitriding of the surfaces will proceed for a heating time required to cause nitriding of a surface of the martensitic stainless steel at a predetermined depth of the nitriding. Further, the stainless steel so treated is quenched to harden the inside thereof and simultaneously harden the surface thereof.

The organic solvent used in the present invention is required to dissociate surplus carbon by heat decomposition. More specifically, the organic solvent is required to dissociate 1~3 atoms of active carbon when the organic solvent is decomposed by heat. For example, methyl acetate $CH_3COOCH_3$ or isopropyl alcohol $(CH_3)_2CHOH$ may be used as the organic solvent. These organic solvents are heat decomposed as follows, respectively.

$$CH_3COOCH_3 \rightarrow C + 2CO + 3H_2$$

$$(CH_3)_2CHOH \rightarrow 2C + CO + 4H_2$$

The surplus carbon is required to produce nascent oxygen, to reduce the oxygen molecule and oxidable substances such as water included as impurities in the nitrogen gas, and also to reduce oxidable substances which may adhere to the stainless steel to be treated or to jigs or tools.

The neutral or weakly reducing atmosphere is an atmosphere wherein neither carburizing nor decarburizing occurs or wherein, even if the carburizing or decarburizing occurs, the atmosphere serves as a neutral atmosphere because of the slow reaction speed of this treatment.

The amount of organic solvent must be chosen such that the volume of any inflammable gases produced; e.g. hydrogen and carbon monoxide, are below the limit at which an explosion might occur. This limit is preferably in the range between 2.5~5 volume % the remaining gas being about 97.5% to 95% by volume nitrogen gas. Therefore, the resulting gaseous atmosphere consists of 97.5~95 volume % of nitrogen gas, 0.5~1.5 volume % of CO and 2~3.5 volume % of $H_2$, the remaining atmosphere being $H_2O$ and $CO_2$ as impurities.

Further, the quenching temperature is within approximately 150° C. to room temperature in a quenching gas selected from the resulting gas or nitrogen gas at which an oxidized colored film is not formed on the surfaces of the stainless steel. Preferably, the quenching temperature is about 100° C.

According to this invention, the atomic nitrogen is infiltrated into the surface layer of the martensitic stainless steel and the surface is hardened more than the inside thereof. As a result of this, the resistance to planar pressures by loads and the strength of the martensitic stainless steel can be increased and the stainless steel has bright surfaces and high corrosion resistance.

Theoretically, we have found that the process according to the present invention facilitates the generation of atomic nitrogen from nitrogen gas and therefore the nitriding process can be better promoted for the following reasons.

The nitrogen gas reacts with nascent oxygen to form atomic nitrogen in accordance with formula (4).

$$N_2+O \rightarrow NO+N+75\ \text{kcal} \ldots \quad (4)$$

Active carbon generated by heat decomposition of the organic solvent and carbon dioxide gas in the reducing gas dissociate nascent oxygen in accordance with the following formulae (5) and (6), and atomic nitrogen is formed in accordance with formula (4).

$$CO_2 \rightarrow CO+O+126.11\ \text{kcal} \ldots \quad (5)$$

$$2CO_2+C \rightarrow 3CO+O+3.55\ \text{kcal} \ldots \quad (6)$$

It is known that conversion of the nitrogen gas to atomic nitrogen by the reaction of formula (4) proceeds relatively easily.

The nascent nitrogen dissociated in accordance with formula (4) on the surface of the martensitic stainless steel to be treated is immediately adsorbed and diffused whereby the nitriding process proceeds.

PREFERRED EXAMPLES OF THE INVENTION

Examples of the simultaneous case hardening quenching treatment by a process according to this invention will be explained hereinafter.

EXAMPLE 1

Figure 1:
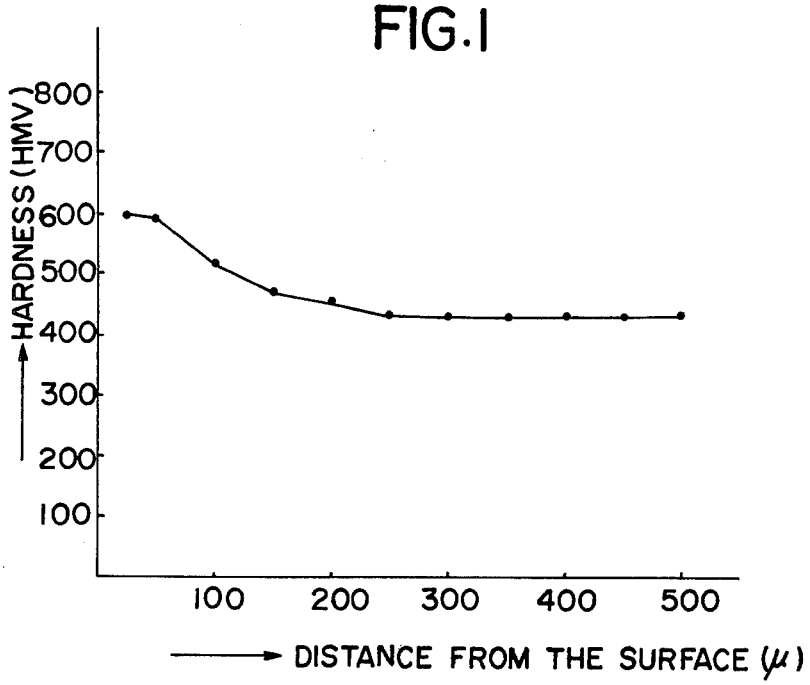
FIG. 1 illustrates the results of a test result of the distribution of hardness in the surface hardened layer and the inside hardened layer of the martensitic stainless steel treated by a process according to the present invention.

A screw made of a martensitic stainless steel (SUS 410 according to JIS standards) was heated at a temperature of 1050° C. for 10 minutes in a gaseous atmosphere consisting of 97 volume % of nitrogen gas and 3 volume % of gases resulting from the decomposition of an organic solvent of isopropyl alcohol, and then quenched in nitrogen gas at a temperature of 100° C. The distribution of the hardness of the screw in terms of the depth from the surface was measured and shown in FIG. 1. It is clear from FIG. 1 that the hardness of the inside was HV430 (Vickers hardness 430) whereas the maximum hardness of the surface was about HV600, and a surface hardened layer having a depth of about 250 μm was obtained. The screw was therefore found to have sufficient strength for tapping.

Figure 2:
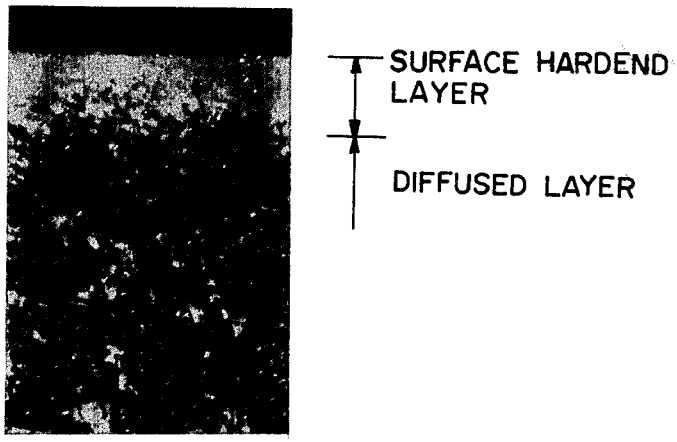
FIG. 2 is a cross sectional photograph showing changes in the structures of the surface and the inside of the martensitic stainless steel treated by a process according to the present invention.

The screw (SUS 410) thus treated was subjected to a corrosion test. The screw was corroded in a solution prepared by adding nitric acid to a saturated hydrochloric acid solution of ferric chloride. Changes in structure starting from the surface were observed and shown in FIG. 2. It is seen from FIG. 2 that a nitrogen-dissolved layer having high corrosion resistance was formed on the surface.

EXAMPLE 2

Inner and outer bearing races made of JIS 440 martensitic stainless steel were treated under the following conditions. The heating temperature was 1030° C., and the heating time was 10 minutes. The gaseous atmosphere consisted of 97 volume % of nitrogen gas and 3 volume % of the decomposed gases (0.6 volume % of CO and 2.4 volume % of $H_2$) produced by decomposition of isopropyl alcohol. The quenching atmosphere was the gaseous atmosphere and the quenching temperature was 100° C. The result of this example 2 was that the resistance to wear of the raceway track was increased.

EXAMPLE 3

Figure 3:
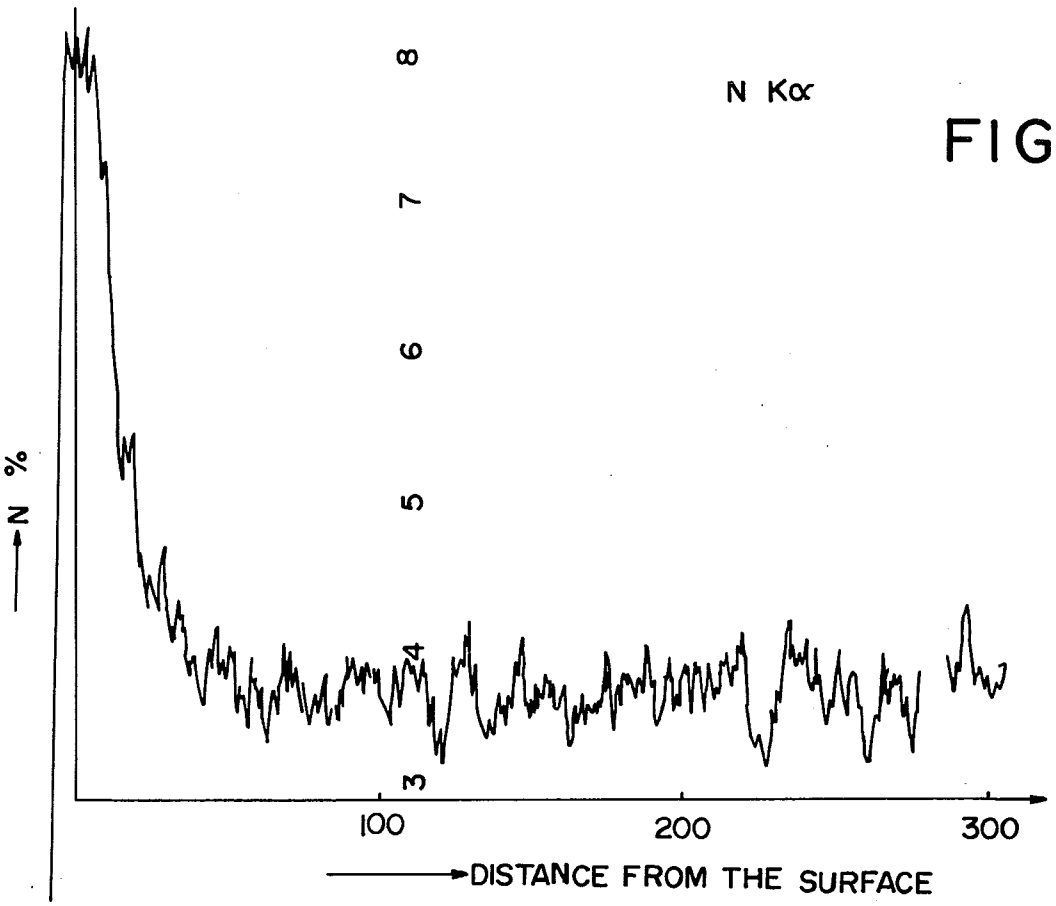
FIG. 3 illustrates the distribution of nitrogen concentration from the surface of the martensitic stainless steel treated by a process according to the present invention.

A cooking knife made of martensitic stainless steel of JIS 440A was heated in the same gaseous atmosphere as set forth in the above example 1 at a temperature of 1100° C. for 6 minutes, and quenched in nitrogen gas. The distribution of nitrogen concentration in terms of the depth from the surface was measured by a microanalyzer with regard to the cross section of the resulting product. The results are shown in FIG. 3 from which it is seen that nitrogen diffuses from the surface to a depth of about 40 μm.

EXAMPLE 4

A plate material made of martensitic stainless steel of JIS 440C which had dimensions of 2×60×80 (mm) was heated in the same gaseous atmosphere as in example 1 at a temperature of 1050° C. for 6 minutes and subsequently quenched in the same gaseous atmosphere at a temperature of 100° C.

In order to clarify the corrosion resistance of the case hardened layer of the stainless steel plate thus treated, the degree of rust occurrence by salt spray pursuant to the measurement method defined by JIS Z2371 and Z2912 was measured. In each run, five test specimens were used, and the degree of rust occurrence was tested comparatively at a temperature of 35° C. for 96 hours. The results are shown in the following Table 2.

TABLE 2

| Treating method | Average degree of rust occurrence | |
|---|---|---|
| Method of the Invention | 0 | grade A |
| Carbonitriding at low temperature | 3 | grade B |
| Quenching in a salt bath - electropolishing | 2 | grade B |

The average degree of rust occurrence was measured in the following manner. A measuring device was used having a measuring area of 50×50 mm composed of 100 square sections, each of which has an area of 25 $mm^2$. This device was placed on the test specimen so that the number of sections where rust was produced was counted. For an average degree of rust occurrence corresponding to grade A, there is no rust section. In the case of grade B, there are 1~10 rust sections.

Table 2 demonstrates that the degree of rust occurrence in the surface hardened layer in accordance with this invention corresponds to grade A, and its corrosion resistance is superior to either the product subjected to carbonitriding at low temperatures or the product treated with a salt bath.

It is clear from the above description and the experimental results of the various examples that according to the simultaneous case hardening quenching method of this invention, a very small amount of an organic solvent is added to nitrogen gas, and the reaction of active gas formed by heat decomposition promotes nitriding and forms a non-explosive and neutral or weakly reducing atmosphere. Subsequently, the martensitic stainless steel is heated and then quenched in this gaseous atmosphere. As a result, the surface hardened layer will have high corrosion resistance, and as a result of quenching a bright surface is obtained.

What is claimed is:

1. A process for case hardening martensitic stainless steel comprising the steps of:

forming a non-explosive and neutral or weakly reducing atmosphere consisting essentially of about 97% by volume nitrogen gas, the remainder consisting substantially of about 0.6% by volume carbon monoxide and about 2.4% by volume hydrogen gases being produced by heat decomposition of an organic solvent mixed with the said nitrogen gas;

heating a martensitic stainless steel at a solution heat treatment temperature within an approximate range of 1030° C. to 1100° C., said martensitic stainless steel being heated in said atmosphere for a heating time within an approximate range of 6 to 10 minutes; and quenching said stainless steel in a quenching gas selected from the group consisting of nitrogen gas and said atmosphere at a quenching temperature of about 100° C.

2. A process as claimed in claim 1, wherein the organic solvent is selected from group consisting of isopropyl alcohol and methyl acetate.

* * * * *